US009184484B2

(12) United States Patent
Tanbakuchi et al.

(10) Patent No.: US 9,184,484 B2
(45) Date of Patent: Nov. 10, 2015

(54) FORWARD COUPLED DIRECTIONAL COUPLER

(71) Applicant: Keysight Technologies, Inc., Minneapolis, MN (US)

(72) Inventors: Hassan Tanbakuchi, Santa Rosa, CA (US); Matthew Richter, Santa Rosa, CA (US); Chen-Yu Chi, Santa Rosa, CA (US); Richard L. Rhymes, Santa Rosa, CA (US); Cinda Lynette Craven, Santa Rosa, CA (US)

(73) Assignee: Keysight Technologies, Inc., Santa Rosa, CA (US)

( * ) Notice: Subject to any disclaimer, the term of this patent is extended or adjusted under 35 U.S.C. 154(b) by 320 days.

(21) Appl. No.: 13/665,124

(22) Filed: Oct. 31, 2012

(65) Prior Publication Data

US 2014/0118082 A1 May 1, 2014

(51) Int. Cl.
*H01P 5/16* (2006.01)
*H01P 5/18* (2006.01)

(52) U.S. Cl.
CPC ..... *H01P 5/185* (2013.01)

(58) Field of Classification Search
CPC ..... H01P 5/18; H01P 5/184–5/185
USPC ..... 333/116, 109–112, 117
See application file for complete search history.

(56) References Cited

U.S. PATENT DOCUMENTS

| | | | | |
|---|---|---|---|---|
| 5,111,165 | A | 5/1992 | Oldfield | |
| 5,625,328 | A | 4/1997 | Coleman, Jr. et al. | |
| 7,183,877 | B2 | 2/2007 | Juenemann et al. | |
| 2012/0068786 | A1 * | 3/2012 | Juenemann et al. | 333/116 |

OTHER PUBLICATIONS

Uysal et al., "Novel Microstrip Multifunction Directional Couplers and Filters for Microwave and Millimeter-Wave Applications," IEEE Transactions of Microwave Theory and Techniques, vol. 39, No. 6, Jun. 1991.

Fuji et al., "Size-Reduction of Coupled-Microstrip 3 dB Forward Couplers by Loading with Periodic Shunt Capacitive Stubs," IEEE, 2005.

Chang et al., "Enhanced Forward Coupling Phenomena Between Microstrip Lines on Periodically Patterned Ground Plane," IEEE, 2001.

Liu et al., "Forward Coupling Phenomena Between Artificial Left-Handed Transmission Lines," Journal of Applied Physics, vol. 92, No. 9, Nov. 1, 2002, pp. 5560-5565.

* cited by examiner

*Primary Examiner* — Benny Lee
*Assistant Examiner* — Albens Dieujuste

(57) ABSTRACT

Described is a directional coupler for forward coupling energy from an input port to a coupling port. The directional coupler has a coupling factor and an operating frequency and an operating wavelength corresponding to the operating frequency.

28 Claims, 9 Drawing Sheets

FORWARD COUPLED DIRECTIONAL COUPLER

BACKGROUND

Directional couplers are general purpose tools used in radio frequency ("RF"), microwave, and millimeter wave signal routing for isolating, separating or combining signals. They find wide application in RF, microwave, millimeter wave, and optical frequency networks and systems. They perform a variety of functions including, for example, splitting and combining power in mixers, power monitoring and sampling power from sources for level control and source leveling, isolating signal sources, separating incident and reflected signals in network analyzers, allowing for swept transmission and reflection measurements, and dividing power among a number of loads.

In general, directional couplers are devices that have two transmission lines that are physically positioned close together. These transmission lines may be, for example, coaxial transmission lines, waveguide transmission lines, optical transmission lines, and stripline and microstrip transmission lines. In operation, the electromagnetic field of one transmission line is utilized to couple energy into the second transmission line. Based on then design, directional couplers couple a predetermined amount of power input on the first transmission line to the second transmission line which is typically referred to as the coupled transmission line.

For planar-transmission-line structures, directional couplers are usually constructed utilizing microstrip or stripline transmission lines which may be constructed on a printed circuit board ("PCB"). In FIG. 1, a prospective view of an example of an implementation of a known directional coupler 100 constructed on a PCB utilizing microstrip transmission lines 102 and 104 is shown. The PCB includes a dielectric substrate 106, which has a thickness h 107, and ground plane 108. The first transmission line 102 and second transmission line 104 are spaced closely together with a spacing s 110 (generally known as the "gap") apart. Both the first transmission line 102 and second transmission line 104 have a width w 112 and a thickness (not shown) above the substrate 106. In this example, the directional coupler 100 is a four port passive device having an input port 114, through port 116, coupled port 118, and isolated port 120. It is appreciated by those skilled in the art that the directional coupler 100 may be housed in a shielded box and coaxial-transmission-line connectors may be bonded to each port 114, 116, 118, and 120 of the microstrip transmissions lines 102 and 104. The dielectric substrate 106 may be, for example, fused silica or $S_iO_2$.

Typically the directional coupler 100 is constructed in a backward configuration in that a signal input into the input port 114 propagates between the input port 114 to the through port 116 (also known as an output port) via the fast transmission line 102. When the signal propagates along the first transmission line 102 it creates an electromagnetic field which couples energy onto the second transmission line 104. Some of the electromagnetic field crosses the second transmission line 104 and the electric field from the first transmission line 102 includes an equal and opposite charge on the second transmission line 104 giving rise to an electric field that is reversed in direction from that of the first transmission line 102. Since the there is a reversal in the electric field, there is also an accompanied reversal in the direction of propagation along the second transmission line 104. As such, while the signal input into the input port 114 propagates along the first transmission line 102 from the input port 114 to the through port 116, the coupled signal induced on the second transmission line 104 propagates in the opposite direction (i.e., in the direction from the isolated port 120 to the coupled port 118). For this reason, the directional coupler 100 is usually known as a backward coupler because it utilizes the backward wave coupling principle, which means that its coupling direction of propagation is opposite the propagation direction of the main signal. It is appreciated by those skilled in the art that the direction coupler 100 may be analyzed utilizing techniques involving analyzing the even-symmetry and odd-symmetry modes of operation of the transmission lines 102 and 104 along a plane of symmetry defined along a line of symmetry 122. Based on this approach, the odd and even modes of the resulting combined signal waveform on the pair of coupled transmission lines 102 and 104 travel at the same velocity but, due to the different characteristic impedances of the transmissions lines 102 and 104, cancel at the isolated port 120 and combine constructively at the coupled port 118 and through port 116.

Turning to FIG. 2A, a front-side view of the direction coupler 100 is shown. In FIG. 2A, the electric field 200 and magnetic fields 202 for the even-symmetry mode on the coupled microstrip transmission lines 102 and 104 are shown. Similarly, in FIG. 2B, a front-side view of the direction coupler 100 is also shown. In FIG. 2B, the electric field 204 and magnetic fields 206 for the odd-symmetry mode on the coupled microstrip transmission lines 102 and 104 are shown.

In this example, the direction coupler 100 is designed to pass most of the energy input into the input port 114 of the first transmission line 102 to the through port 116. A portion of the energy (which is not passed to the through port 116) will be coupled to the second transmission line 104 with most of that coupled energy being passed to the coupled port 118; however, some of the coupled energy will also be passed to the isolated port 120. In practice, the direction coupler 100 will be designed to have a pre-determined amount of energy passed to both the through port 116 and coupled port 118 while at the same time minimizing the amount of energy passed to the isolated port 120. The design parameters and techniques for designing the direction coupler 100 are well-known by those skilled in the art and include, for example, varying the transmission line 102 and 104 widths w 112, gap spacing s 110, length l 124 of the coupling sections, shapes, bends, thickness, and materials of the transmission lines 102 and 104, properties of the substrate 106, etc.

In general, the directional coupler 100 is characterized by its coupler factor, isolation, and directivity. Its coupling factor is defined as the ratio of power obtained at the coupled port 118 and the power input into the input port 114. In mathematical form the coupling factor is described as $$C = -10\log\left(\frac{Power_{CoupledPort}}{Power_{InputPort}}\right)\text{dB},$$

where dB stands for decibels. The coupling factor represents a primary property of a directional coupler 100. It is a negative quantity (even though in practice the minus sign is frequently dropped) and it cannot exceed 0 dB for a passive device. Additionally, the coupling factor is not constant and varies with frequency.

Similarly, the isolation of the directional coupler 100 is defined by the ratio of power obtained at the isolated port 120 and the power input into the input port 114. In mathematical form the isolation of the direction coupler 100 is described as $$I = -10\log\left(\frac{Power_{IsolatedPort}}{Power_{InputPort}}\right)\text{dB}.$$

The isolation should be as high as possible to reduce the amount of power being transmitted to the isolation port (i.e., isolated port 120).

Directivity is directly related to isolation and is the ratio of power obtained at the isolated port 120 and the power obtained at the coupled port 118. Again, in mathematical form the directivity of the directional coupler 100 is described as $$D = -10\log\left(\frac{Power_{IsolatedPort}}{Power_{CoupledPort}}\right)\text{dB}.$$

As a result of this, the directivity may also be described as the ratio of the isolation and coupling factor of the directional coupler 100. In mathematical form this would be written as $$D = \frac{I}{C}\text{dB}.$$

In general, directivity has been widely used as a figure of merit to quantify the quality and usefulness of a directional coupler. The directivity should be as high as possible for a properly designed directional coupler. It is appreciated by those skilled in the art that for a tightly coupled coupler (such as, for example, a 3 dB directional coupler), a high directivity is not difficult to achieve. Unfortunately, this is not true of a loosely coupled directional coupler such as, for example, a 13 dB directional coupler.

As an example, a 3 dB directional coupler only needs to have an isolation of 18 dB to achieve 15 dB directivity. However, for a 13 dB directional coupler to achieve the same 15 dB directivity it will need to have at least 28 dB isolation for the entire operating frequency of the directional coupler. This high isolation requite lent for a broadband loosely coupled high directivity coupler becomes extremely challenging in the design of a conventional backward directional coupler.

It is well known that to design a high directivity directional coupler, it is necessary to satisfy the following relationship $$Z_{0e}Z_{0o}=Z_0^2,$$

where $Z_{0e}$ and $Z_{0o}$ are the even and odd mode impedances of the couple-line structure and $Z_0$ is the characteristic impedance of the directional coupler 100. In addition to the $Z_{0e}Z_{0o}=Z_0^2$ relationship, the even and odd impedances also need to follow a certain design profile as the coupling sections 126 and 128 moving away from the input port 114 toward the through port 116. This usually results in an asymmetric form factor with a very tight gap spacing 130 at one end and wide gap spacing 132 at the other end. The gap spacing between the two coupled lines 126 and 128 controls the amount of coupling between each small section of the coupler along the signal propagation direction. A wrong spacing between the two coupled lines 126 and 128 translates directly to the wrong even and odd mode impedances and results in a different characteristic impedance $Z_0$. This can cause undesired reflection at each port and can degrade the isolation of the directional coupler 100. Depending on the dielectric material used in the substrate 106, this tight gap 130 at the input side may be extremely small and hard to build especially for a low dielectric constant material.

Since the directivity is the ratio between the isolation and coupling factor, in order to produce a high directivity it is important that the isolation be as high as possible. It is well known that in a directional coupler in the backward configuration, a good isolation is achieved by the cancellation of the two different propagation modes (even and odd) at the isolation port (i.e., isolated port 120). This cancellation relies on a matched propagation velocity between the two modes. If the two modes do not have the same propagation velocity, then when the two modes propagate to the isolation port they will not be perfectly cancelled. This results in a degraded isolation and lowers the directivity of the directional coupler.

To achieve a matched propagation velocity, known approaches have included utilizing stripline and air dielectric slab line structures to preserve the transverse electromagnet ("TEM") mode and minimize the difference of the two propagation velocities. With a pure TEM mode supported by these two structures, the backward directional couplers can have the same propagation velocities between the even and odd modes, therefore, a high directivity coupler may be achieved. However, stripline and slab line couplers may not be a perfect solution for a pure planar hardware implementation in a RF, microwave, or millimeter wave circuit.

Many times a microstrip structure is a preferred way to implement in hardware. However, by the nature of microstrip structure, it does not support a pure TEM mode. Without a pure TEM mode, the two propagation modes will not be cancelled at the isolation port of the directional coupler. Therefore, a high directivity backward directional coupler is difficult to achieved and built using standard microstrip technology.

In order to solve this problem a few known approaches have been developed to match or minimize the difference of the propagation velocities in the backward directional coupler utilizing microstrip construction. These approaches include utilizing a wiggled coupling structure to slow down the odd mode, using coplanar waveguide ("CPW") to lower the difference of the two propagation velocities, and a combination of both. Unfortunately, these approaches are complex and do not properly solve the problem. As an example, the approach of utilizing a wiggled coupling structure requires the utilization of extra wiggled saw teeth to add extra length for the fast moving odd-mode. This adds extra design challenges to the already difficult problem. The CPW line solution only lowers the difference of the two propagation velocities and does not fully solve the issue. Attempts at combining both of these approaches have included implementing the wiggled sections to compensate the propagation velocity and also utilizing a suspended CPW line to further lower the difference of the two propagation velocities. Unfortunately, this approach further increases the complexity of the overall circuit. It also requires extra bonding wires along the coupled structure to equalize the CPW's two separated ground plans and prevent higher propagation modes.

As a result, there is a need for an improved loosely coupled directional coupler that provides high directivity.

SUMMARY

Described is a directional coupler for forward coupling energy from an input port to a coupling port. The directional coupler has a coupling factor and an operating frequency and an operating wavelength corresponding to the operating frequency.

The directional coupler includes a first transmission line having an input port, through port, and a first coupling section and a second transmission line having an isolated port, a coupled port, and a second coupling section. The first coupling section is located at a first position and the second coupling section is located at a second position, which is located proximate to the first position. A spacing between the first position and second position define a gap spacing between the first coupling section and the second coupling section. The isolated port is located closer to the input port than the coupled port is located to the input port and the gap spacing is configured to minimize a transfer of energy from the input port to the isolated port. The first coupling section has a first length and the second coupling section has a second length and the second length is longer than a wavelength of the operating wavelength. The second length is predetermined to produce a transfer of energy from the input port to the coupled port that corresponds to the coupling factor.

Also described is a slab line directional coupler for forward coupling energy from an input port to a coupling port. The slab line directional coupler has a coupling factor and an operating frequency and an operating wavelength corresponding to the operating frequency.

The slab line directional coupler includes a first transmission line having an input port, through port, and a first coupling section and a second transmission line having an isolated port, the coupled port, and a second coupling section. The first coupling section is located at a first position and the second coupling section is located at a second position, which is located proximate to the first position. A spacing between the first position and second position define a gap spacing between the first coupling section and the second coupling section and a dielectric load is connected between the first transmission line and the second transmission line. The dielectric load is configured to force the first transmission line to propagate even mode signals, having a first propagation velocity, and odd mode signals, having a second propagation velocity, in a direction from the input port to the through port. The gap spacing is configured to minimize a transfer of energy from the input port to the isolated port. The first coupling section has a first length and the second coupling section has a second length. The second length is longer than a wavelength of the operating wavelength and the second length is predetermined to produce a transfer of energy from the input port to the coupled port that corresponds to the coupling factor.

In an example of operation, both the directional coupler and slab line directional coupler perform a process that includes propagating an input signal, a the input port, along the first coupling section in the direction of the through port and coupling the propagated input signal to the coupling port. In this example, coupling includes coupling from the first coupling section to the second coupling section across a uniform gap spacing and coupling in the direction of the propagated signal. The second coupling section has a second coupling length that is multiple wavelengths of an operating wavelength of the directional coupler. Additionally, in this example, propagating an input signal includes propagating an even mode signal having a first propagation velocity and propagating an odd mode signal having a second propagation velocity, where the first propagation velocity is different than the second propagation velocity.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

In order to solve the problems described earlier, an improved loosely coupled directional coupler that provides high directivity is disclosed. Specifically, a directional coupler for forward coupling energy from an input port to a coupled port is described. The directional coupler has a coupling factor, operating frequency, and an operating wavelength corresponding to the operating frequency. The directional coupler includes a first transmission line and a second transmission line. The first transmission line has an input port, through port, and first coupling section and the second transmission line has an isolated port, a coupled port, and a second coupling section. The directional coupler also includes a gap spacing between the first coupling section and the second coupling section.

The first coupling section is located proximate to the second coupling section and the isolated port is located closer to the input port than the coupled port is located to the input port. The gap spacing is configured to minimize a transfer of energy from the input port to the isolated port and the first coupling section has a first length and the second coupling section has a second length. The second length is multiple wavelengths of the operating wavelength and is predetermined to produce a transfer of energy from the input port to the coupled port that corresponds to the coupling factor.

In an example of operation, the directional coupler forward couples energy from the input port to the coupled port by performing process that includes propagating an input signal, at the input port, along the first coupling section in the direction of the through port and coupling the propagated input signal to the coupling port. The directional coupler couples the propagated input signal to the coupling port by coupling the propagated input signal to the second coupling section of the second transmission line where the second coupling section is multiple wavelengths, of the operating wavelength of the direction coupler, in length.

Figure 3:
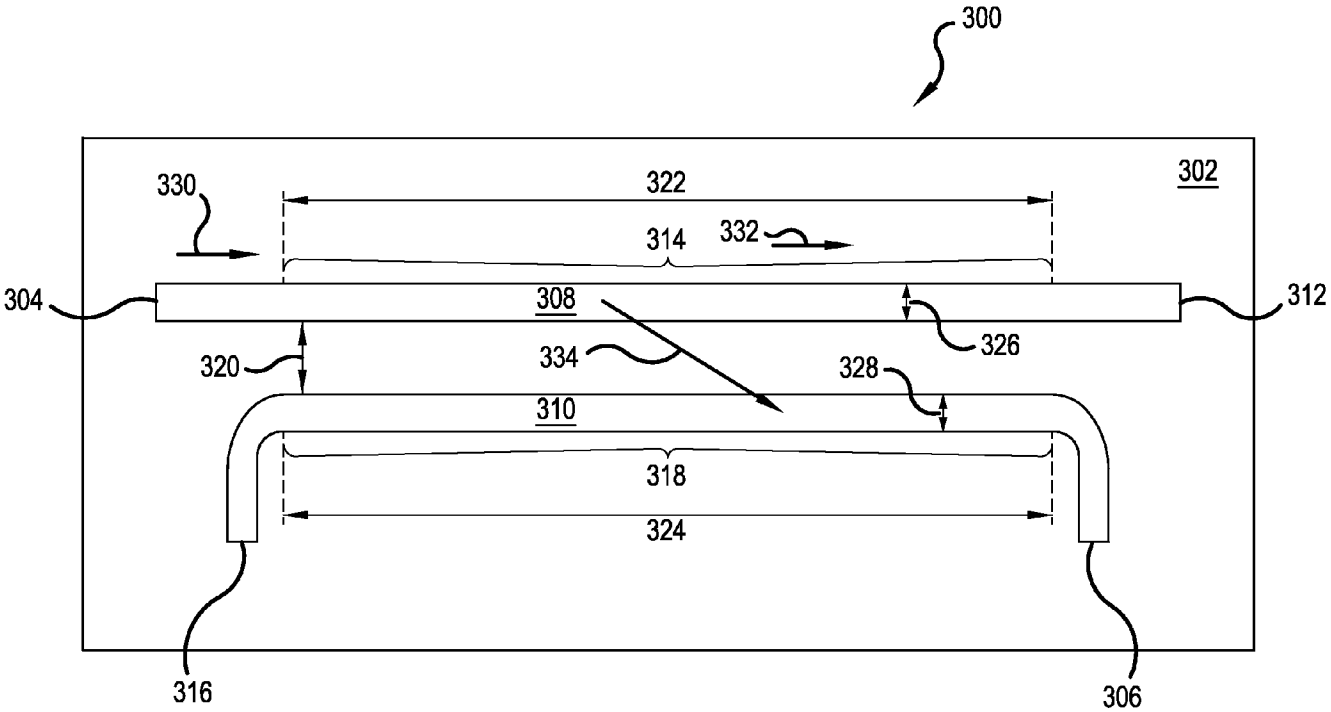
FIG. 3 is a top view of an example of an implementation of a directional coupler, on a PCB, for forward coupling energy from an input port to a coupled port in accordance with the invention.

Turning to FIG. 3, a top view of an example of an implementation of a directional coupler 300, on a PCB 302 (which includes a dielectric substrate), for forward coupling energy from an input port 304 to a coupled port 306 is shown in accordance with the invention. The directional coupler 300 (also referred to as a forward directional coupler) includes a first transmission line 308 and a second transmission line 310. The first transmission line 308 includes the input port 304, a through port 312, and a first coupling section 314 located at a first position. The second transmission line 310 includes an isolated port 316, a second coupling section 318, and the coupled port 306. The second coupling section 318 of the second transmission line 310 is located at a second position proximate to the first coupling section 314 of the first transmission line 308, where the second coupling section 318 and the first coupling section 314 are spaced apart by a gap spacing 320. The first coupling section 314 has a first length 322 and the second coupling section 318 has a second length 324. The first coupling section 314 has a first width 326 and the second coupling section 318 has a second width 328. The gap spacing 320 may be wide and uniform throughout the entire second length 324. Additionally, the first length 322 may be equal to the second length 324.

In this example, the directional coupler 300 is designed to operate at an operating frequency $F_0$, which corresponds to an operating wavelength $\lambda_0$. The directional coupler 300 is a band limited device that operates within a bandwidth around the operating frequency $F_0$ (which may also be referred to the center frequency). As such the directional coupler 300 may have a low frequency $F_L$ of operation and a high frequency $F_H$ of operation, with a corresponding low operating wavelength $\lambda_L$ and high operating wavelength $\lambda_H$ (where it is appreciated by those skilled in the art that the low operating wavelength $\lambda_L$ is longer than the high operating wavelength $\lambda_H$).

Figure 1:
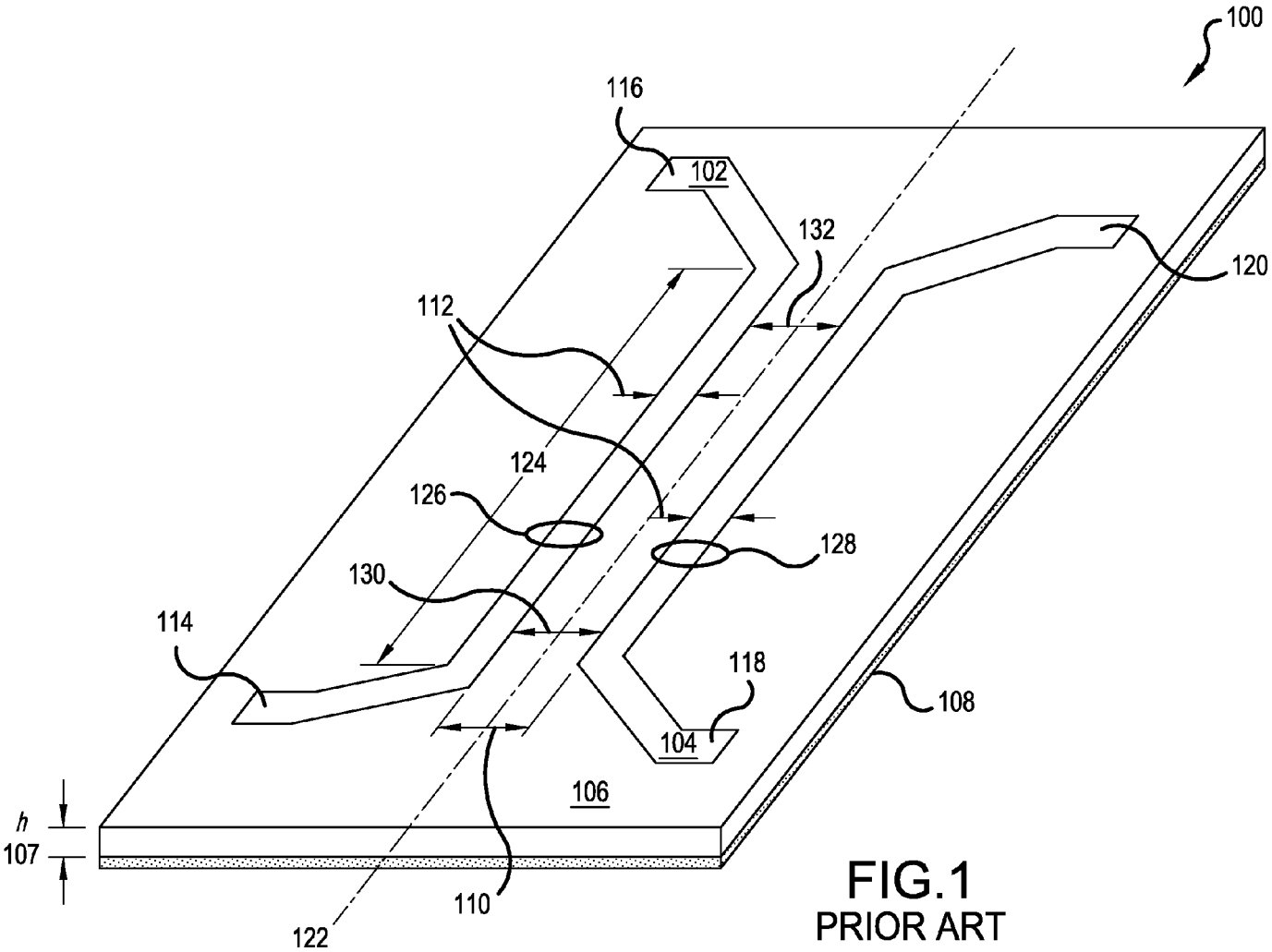
FIG.1 PRIOR ART
FIG. 1 is a prospective view of an example of an implementation of a known directional coupler constructed on a PCB utilizing microstrip transmission lines is shown.
Figure 2A:
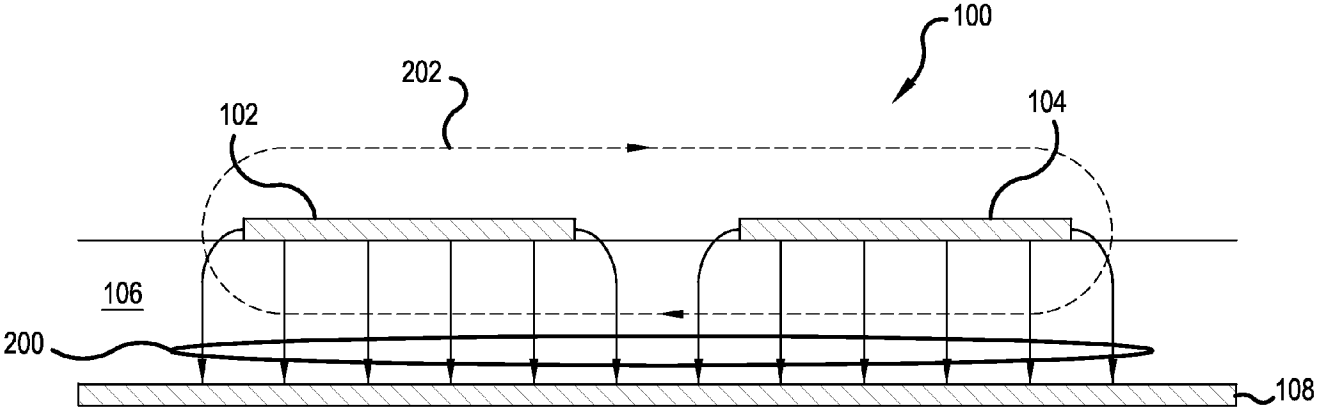
FIG.2A PRIOR ART
FIG. 2A is a front-side view of the known direction coupler shown in FIG. 1 showing the electric and magnetic fields for the even-symmetry mode of operation.
Figure 2B:
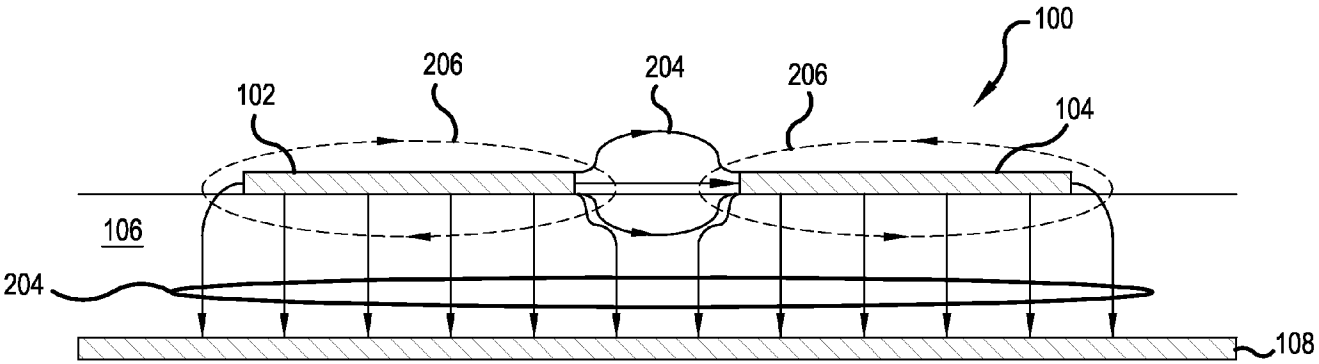
FIG.2B PRIOR ART
FIG. 2B is a front-side view of the known direction coupler shown in FIG. 1 showing the electric and magnetic fields for the odd-symmetry mode of operation.

Unlike the known directional coupler 100, shown in FIG. 1, the directional coupler 300 is designed to forward couple energy injected into the input port 304 to the coupled port 306 where the coupled port 306 is located near the through port 312. The gap spacing 320 is configured to minimize a transfer of energy from the input port 304 to the isolated port 316 and second coupling section 318 is predetermined, and is at least a wavelength of the operating wavelength $\lambda_0$, to produce a transfer of energy from the input port 304 to the coupled port 306 that corresponds to a coupling factor for the directional coupler 300. As an example, the gap spacing 320 may be approximately equal to a quarter wavelength of the operating wavelength $\lambda_0$ and the second length 318 may be multiple wavelengths of the operating wavelength $\lambda_0$.

In general for the same uniformed spaced coupler designed with the same operating frequency $F_0$, same coupling ratio on the same dielectric material, the directional coupler 300 provides a flatter coupling response and wider usable bandwidth than the known backward directional coupler 100. With the same condition applied, the first and second lengths 322 and 324 of first and second coupling sections 314 and 318, and the width of gap spacing 320 of the directional coupler 300 are greater than that of the known directional coupler 100. This wider gap spacing 320 and longer first and second lengths 322, 324 of the first and second coupling sections 314 and 318 make the directional coupler 300 attractive for millimeter-wave applications.

Here it is noted that the term useable bandwidth is a frequency range in which the directional coupler 300 is capable of achieving a certain desired coupling flatness and desired directivity. Additionally, the use of a uniformly spaced wider gap spacing 320 in this implementation differentiates the directional coupler 300 from the known backward directional coupler 100 because a tapered backward coupler with equal propagation velocity on the even and odd modes uses a non-uniformed tapered spacing to achieve wider bandwidth. The directional coupler 300 does not require the same propagation velocity and, therefore, does not require the tapered spacing of the known backward directional coupler 100 while achieving a wide usable bandwidth.

By way of example, for directional coupler 300 operating at 80 GHz inside an alumina ($Al_2O_3$) substrate (not shown), the first and second lengths 322, 324 of first and second coupling sections 314, 318, the gap spacing 320 may be approximately 0.508 mm, the first and second lengths 322 and 324 may be both approximately 3.81 mm, and the first and second widths 326 and 328 of the first and second coupling sections 314, 318 may be each approximately 0.14 mm. Since the operating wavelength $\lambda_0$ in this example is approximately 1.4 mm, the gap spacing 320 is approximately 0.36 of the operating wavelength $\lambda_0$ (i.e., it is wider than a quarter wavelength), the first and second lengths 322,324 of the first and second coupling sections 314 and 318 are approximately 2.72 times the operating wavelength $\lambda_0$, and the first and second widths 326, 328 of the first and second coupling sections 314 and 318 are approximately 0.10 of the operating wavelength $\lambda_0$. Based on these numbers, it is appreciated that the gap spacing 320 for the directional coupler 300 is wide compared to the typical physical size of the known backward directional coupler 100, which has a quarter wavelength long coupling section 126 and 128 and a gap spacing 110 that is approximately 4.4 times smaller than the gap spacing 320 of the directional coupler 300.

In order to determine the gap spacing 110, first and second lengths 322 and 324 of the first and second coupling sections 314 and 318, and first and second widths 326 and 328 of the first and second coupling sections 314 and 318, a designer may utilize many of the same techniques utilized in determining similar parameters in the known backward directional coupler 100. As an example, the designer may obtain these parameters by determining the even and odd mode characteristic impedances $Z_{0e}$ and $Z_{0o}$ and the propagation constant $\Gamma$ (where $\Gamma=\alpha+j\beta$) for the directional coupler 300. This may be accomplished using known analysis techniques including the utilization of full wave analysis tools. Based on the results, the frequency dependency of both $\alpha$ and $\beta$ may be determined. With these additional results, the first and second widths 326 and 328, height (not shown), and gap spacing 320 of first and second coupling sections 314 and 318 may be adjusted by the designer to maximize the difference of the even and odd mode propagation constants while keeping the even and odd mode characteristic impedances $Z_{0e}$ and $Z_{0o}$ close to 50 ohms.

In an example of operation, the directional coupler 300 forward couples energy from the input port 304 to the coupled port 306 by performing a process that includes propagating an input signal 330, at the input port 304, along the first coupling section 314 in the direction of the through port 312 and coupling the resulting propagated input signal 332 to the coupled port 306 via a coupling signal 334. The coupling signal 334 is coupled from the first coupling section 314 to the second coupling section 318 in the direction of the propagated input signal 332 from the input port 304 to the through port 312.

In this example, the directional coupler 300 is a microstrip directional coupler because both the first transmission line 308 and the second transmission line 310 are microstrip transmission lines. Since the first transmission line 308 and second transmission line 310 are microstrip transmission lines they do not support a pure transverse electromagnetic ("TEM") mode. As such, the propagation velocities of the even and odd modes of the propagated input signal 332 are different. Normally, this is a problem that must be compensated for in a known backward directional coupler 100 shown in FIG. 1, however, in the present directional coupler 300 this is the property that allows the directional coupler 300 to provide the desired coupling to the coupled port 306. With a proper predetermined the length of the coupling structure (i.e., the first length 322 and second length 324) and the gap spacing 320, the directional coupler 300 may provide a flat coupling response at the coupled port 306, high isolation at the isolated port 316, and high directivity.

As an example, with a large uniform gap spacing 320, the coupling between the first coupling section 314 and the isolated port 316 is very weak which results in high isolation at the isolated port 316. Additionally, because the propagation velocities of the even and odd modes of the propagated input signal 332 are different, the coupling signal 334 at the coupled port 306 will result in a non-perfectly canceled signal at the coupled port 306; unlike the cancelled signal at the isolated port 120 of the known directional coupler 100 of FIG. 1. With a large gap spacing 320 between the first coupling section 314 and second coupling section 318, the propagation velocities of the even and odd modes of the coupling signal 334 are different but similar. As such, the first and second lengths 322 and 324 of the first and second coupling sections 314 and 318 determine the cancellation of the even and odd modes of the coupling signal 334 at the coupled port 306. With first and second lengths 322 and 324 predetermined, the cancellation of the even and odd modes of the coupling signal 334 are maintained at a constant level at the coupled port 306, and a flat coupling response is produced at the coupled port 306. The first and second lengths 322 and 324 are determined by the high operating wavelength $\lambda_H$.

As a further example, the high operating wavelength $\lambda_H$ at a high frequency $F_H$ of operation of 80 Hz is 0.375 cm in air ($\lambda_{Air}$) and about 0.14 cm in an $Al_2O_3$ dielectric ($\lambda_d$) based microstrip line environment. Utilizing the known directional coupler 100, the quarter wavelength long coupling sections 126 and 128 would typically be about a quarter wavelength long or about 0.035 cm. In the present invention, the first and second lengths 322 and 324 of the first coupling section 314 and second coupling section 318 would be about 0.38 cm, which would be approximately 2.5 wavelengths $\lambda_d$, which would be approximately 10 times the length 124 of the typical known backward directional coupler 100 operating at the same frequency. The result of as wide gap spacing (e.g., gap spacing 320) and long coupling, section with small velocity differences between the even and odd modes of the coupling signal 334 is a near flat coupling response at the coupled port 306 and high isolation at the isolated port 316.

Figure 4:
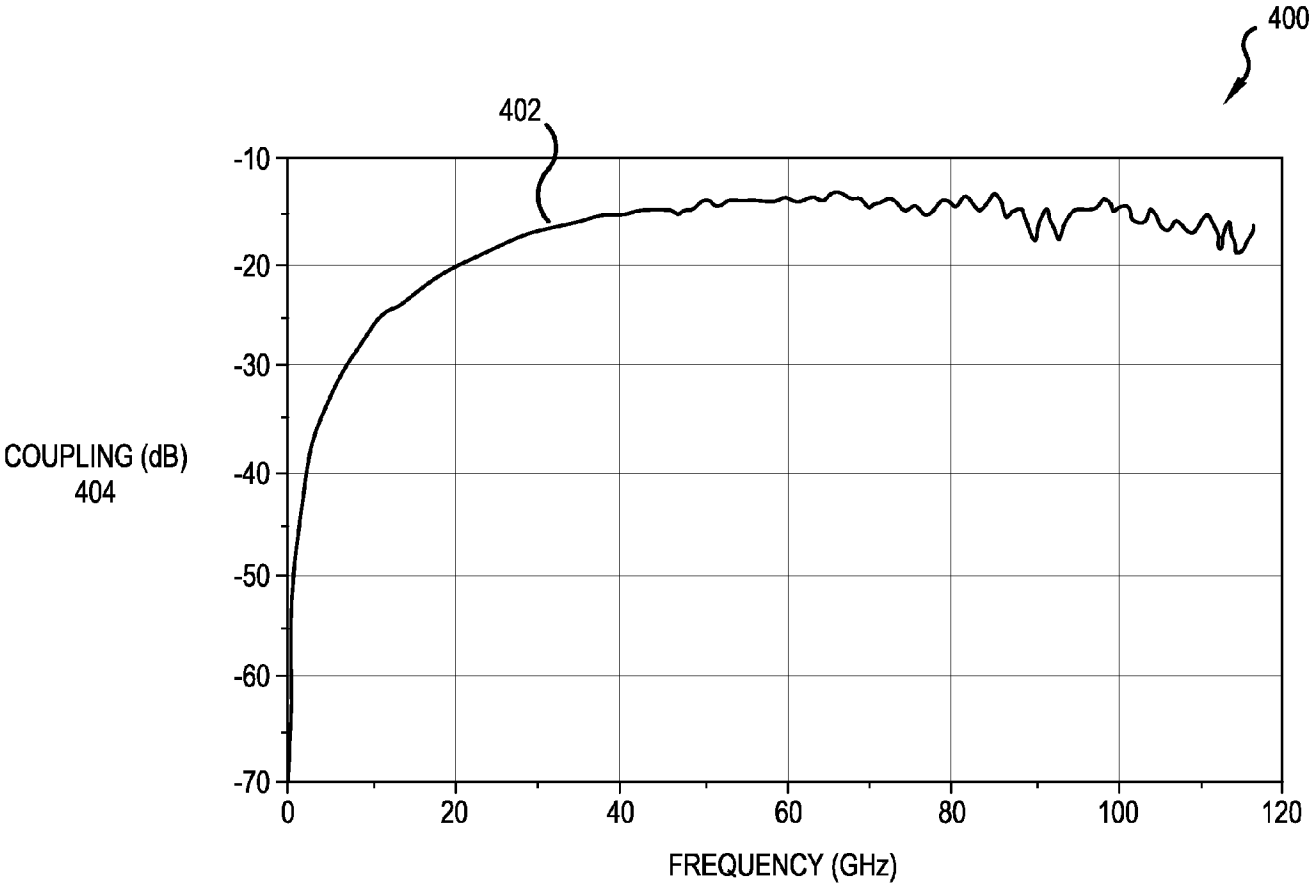
FIG. 4 is a graph of a plot of the coupling, in decibels, at the coupled port, versus frequency, in gigahertz, for the directional coupler shown in FIG. 3.

In FIG. 4, a graph 400 of a plot 402 of the coupling 404, in decibels, at the coupled port 306, versus frequency 406, in gigahertz, is shown for the directional coupler 300 of FIG. 3. In this example, the directional coupler 300 is operating at 80 GHz within an $Al_2O_3$ based microstrip line environment and the first coupling section 314 and second coupling section 318 are the same length and equal to approximately 0.38 cm, which is about four times the high operating wavelength $\lambda_H$ of 0.09 cm. From the plot 402, the directional coupler 300 has about −14+/−1 dB of coupling between 40 to 116 GHz.

Figure 5:
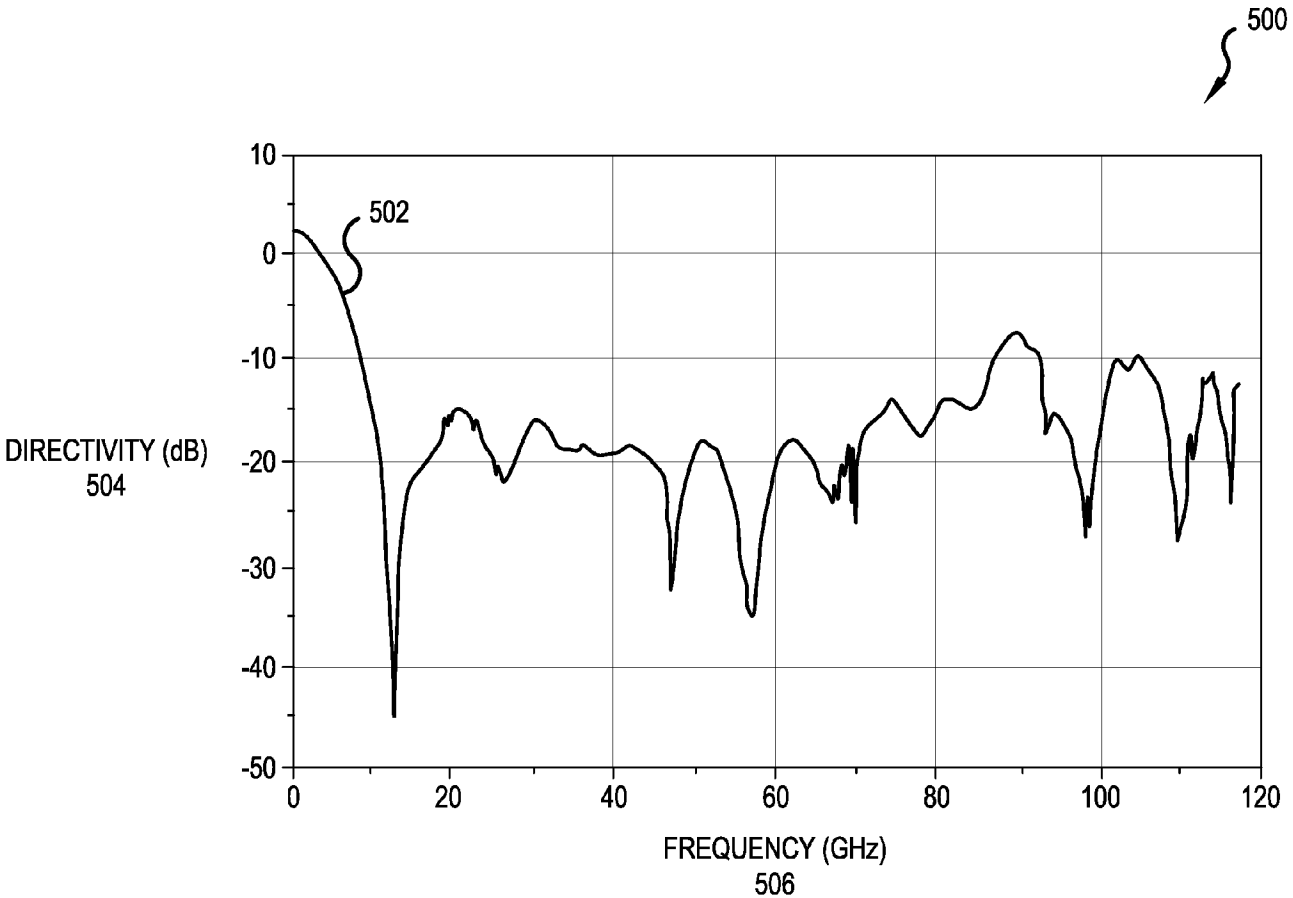
FIG. 5 is a graph of a plot of the directivity, in decibels, versus frequency, in gigahertz, for the directional coupler shown in FIG. 3.

Turning to FIG. 5, a graph 500 of a plot 502 of the directivity 504, in decibels, versus frequency 506, in gigahertz, is shown for the directional coupler 300 of FIG. 3. From the plot 502, the directional coupler 300 has about −10 dB of directivity or greater between 10 to 116 GHz.

Figure 6:
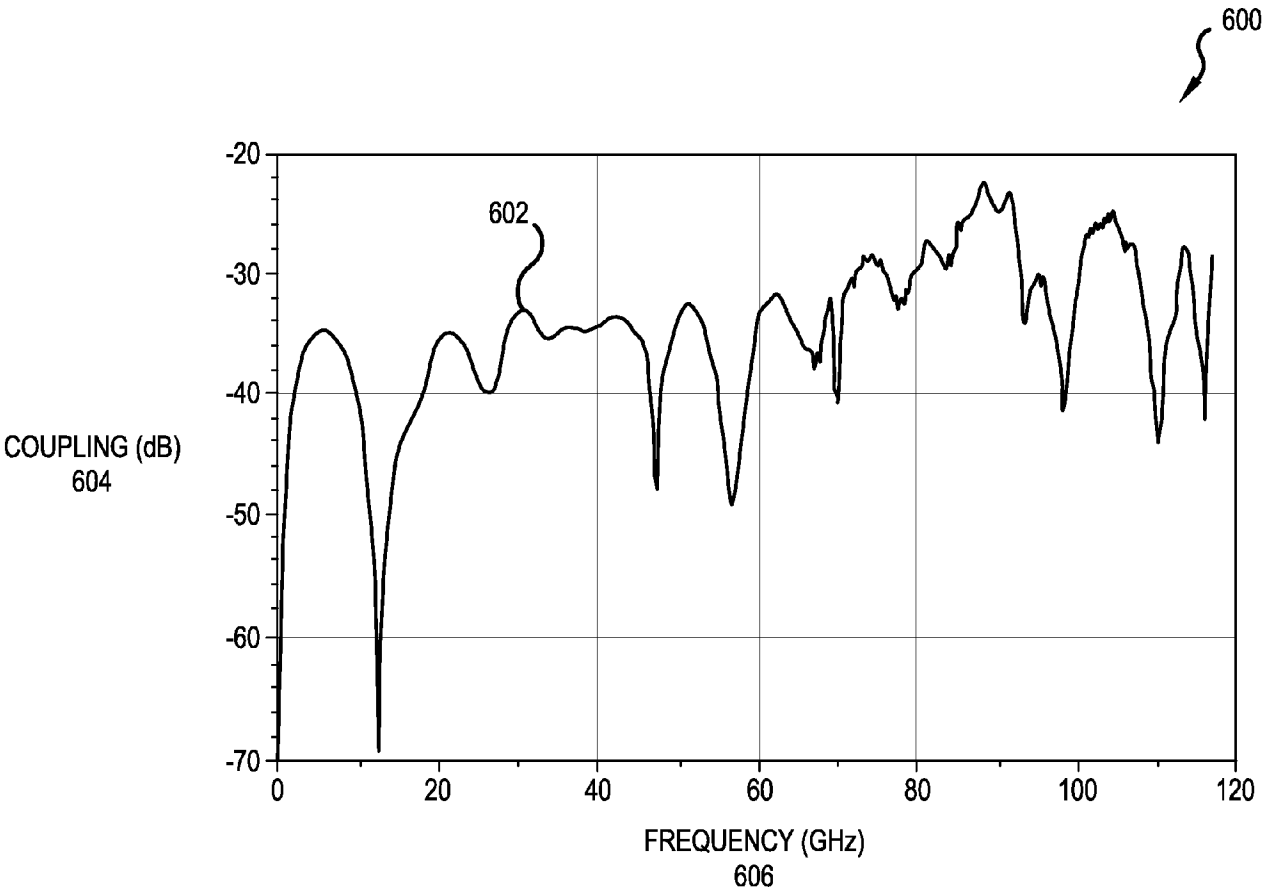
FIG. 6 is a graph of a plot of the isolation, in decibels, versus frequency, in gigahertz, for the directional coupler shown in FIG. 3.

In FIG. 6, a graph 600 of a plot 602 of the isolation 604, in decibels, versus frequency 606, in gigahertz, is shown for the directional coupler 300 of FIG. 3. From the plot 602, the directional coupler 300 has better than −20 dB of isolation at the isolated port 316 for the entire DC-116 GHz measurement range.

Figure 7:
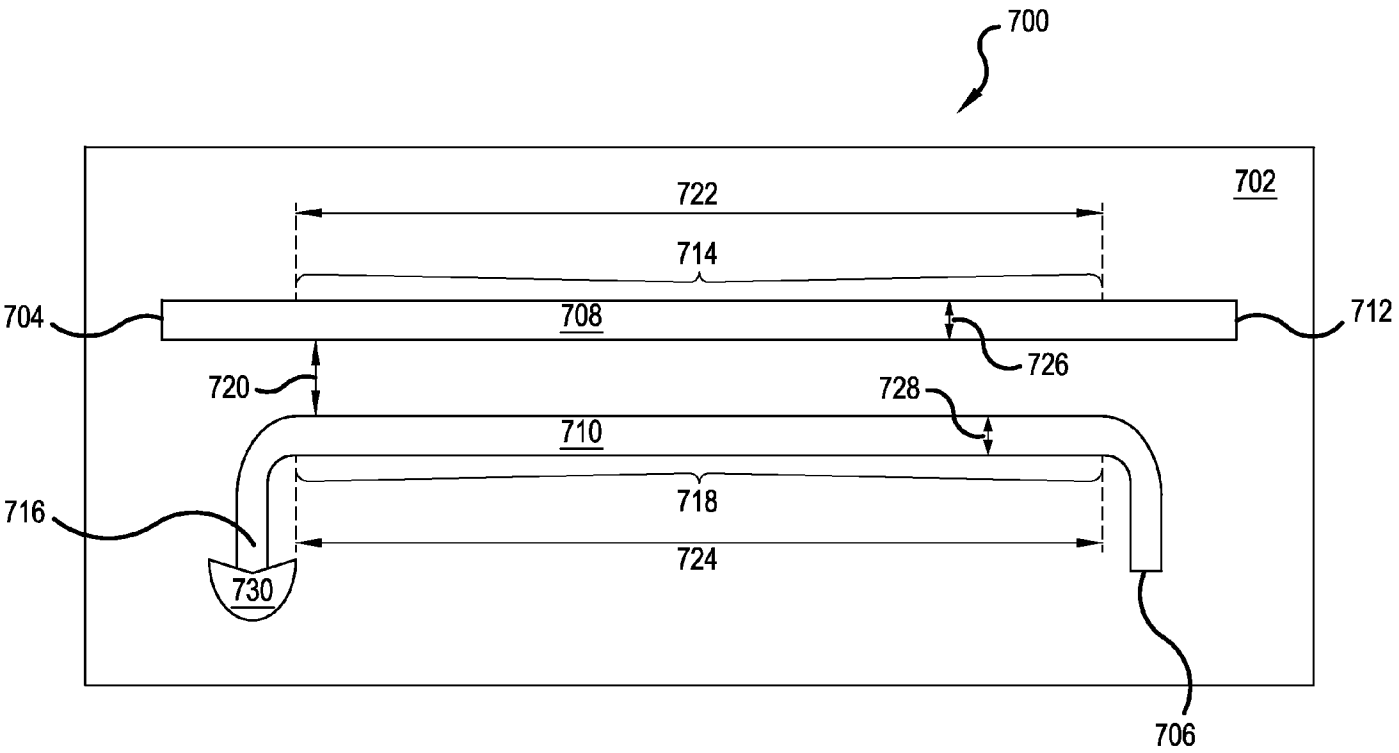
FIG. 7 is a top view of an example of an implementation of to directional coupler, on a suspended thin film substrate, for forward coupling energy from an input port to a coupled port in accordance with the invention.

In FIG. 7, a top view of an example of an implementation of a directional coupler 700, on a suspended thin film substrate 702, for forward coupling energy from an input port 704 to a coupled port 706 is shown in accordance with the invention. The directional coupler 700 includes a first transmission line 708 and a second transmission line 710. The first transmission line 708 includes the input port 704, a through port 712, and a first coupling section 714. The second transmission line 710 includes an isolated port 716, a second coupling section 718, and the coupled port 706. The second coupling section 718 of the second transmission line 710 is located proximate to the first coupling section 714 of the first transmission line 708, where the second coupling section 718 and the first coupling section 714 are spaced apart by a gap spacing 720. The first coupling section 714 has a first length 722 and the second coupling section 718 has a second length 724. The first coupling section 714 has a first width 726 and the second coupling section 718 has a second width 728. The gap spacing 720 may be wide and uniform throughout the entire second length 724. As an example, the gap spacing 720 may be approximately equal to a quarter wavelength of the operating wavelength $\lambda_0$. Additionally, the first length 722 may be equal to the second length 724.

In this example, the first and second transmission lines 708 and 710 are suspended thin-film microstrip lines and the suspended thin film substrate 702 includes a dielectric on which the first and second transmission lines 708 and 710 where the first and second transmission lines 708 and 710 lines are miniaturized microstrip lines. In this example, the second transmission line 710 is coupled to a radial shaped termination load 730. The suspended structure of the directional coupler 700 results in lower effective capacitance from the suspended thin film substrate 702 compared to the example shown in FIG. 3. As a result, to achieve the same line impedance a wider gap spacing 720 is needed than in the non-suspended substrate example shown in FIG. 3. The resulting wider gap spacing 720 may reduce the conductive loss of the first and second thin film transmission lines 708 and 710. In this example, the radial shaped termination load 720 at the isolated port 716 provides a termination for any leakage signal. In this example, the radial shaped termination load 720 does not need a direct current ("DC") short connection to the backside of the suspended thin film substrate 702.

Figure 8:
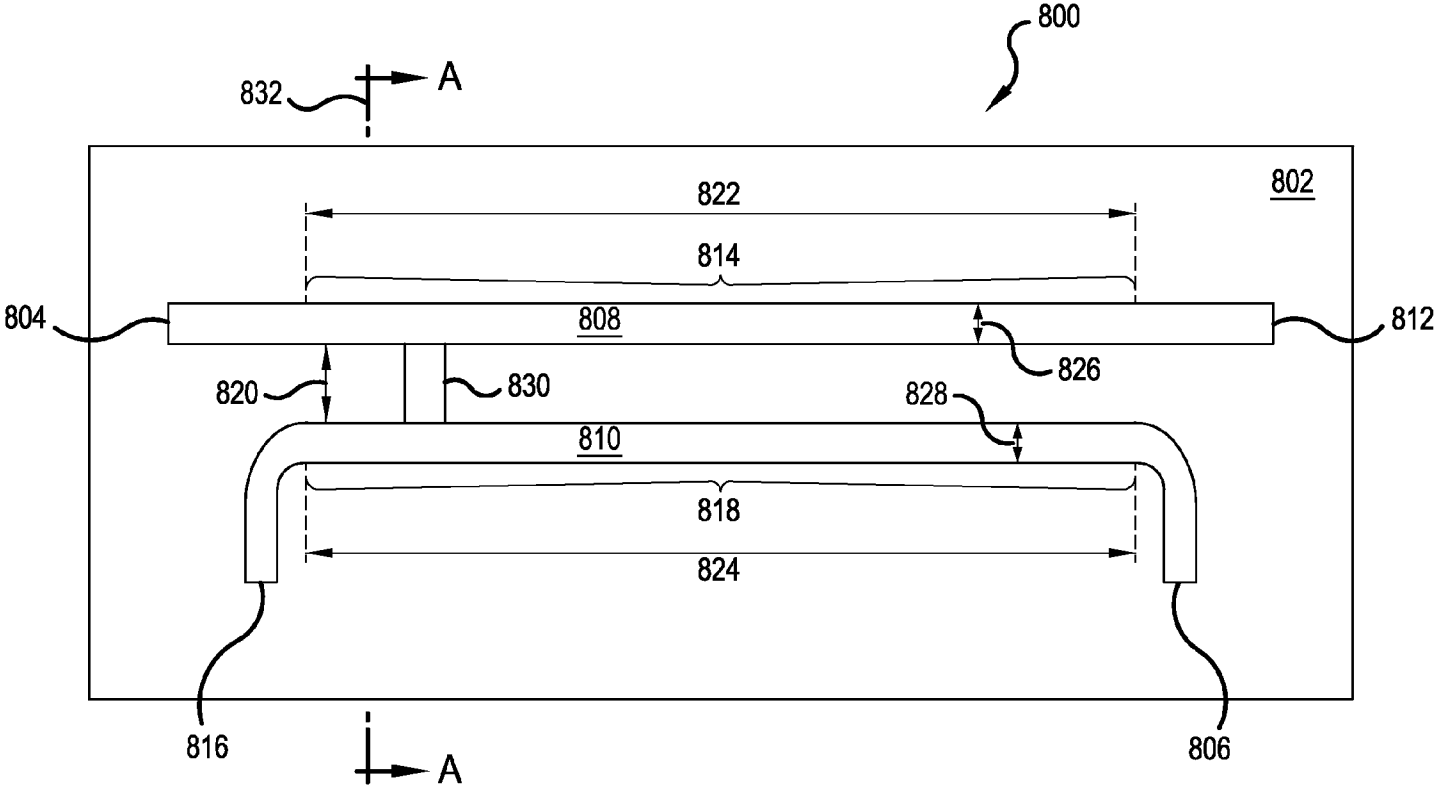
FIG. 8 is a top view of an example of an implementation of to directional coupler, on a slab line structure, for forward coupling energy from an input port to a coupled port in accordance with the invention.

Turning to FIG. 8, a top view of an example of an implementation of a directional coupler 800, on a slab line structure 802, for forward coupling energy from an input port 804 to coupled port 806 is shown in accordance with the invention. The directional coupler 800 includes a first transmission line 808 and a second transmission line 810. The first transmission line 808 includes the input port 804, a through port 812, and a first coupling section 814. The second transmission line 810 includes an isolated port 816, a second coupling section 818, and the coupled port 806. The second coupling section 818 of the second transmission line 810 is located proximate to the first coupling section 814 of the first transmission line 808, where the second coupling section 818 and the first coupling section 814 are spaced apart by a gap spacing 820. The first coupling section 814 has a first length 822 and the second coupling section 818 has a second length 824. The first coupling section 814 has a first width 826 and the second coupling section 818 has a second width 828. The gap spacing 820 may be wide and uniform throughout the entire second length 824. As an example, the gap spacing 820 may be approximately equal to a quarter wavelength of the operating wavelength $\lambda_0$. Additionally, the first length 822 may be equal to the second length 824.

Unlike the examples shown in FIGS. 3 and 6, in FIG. 8 the directional coupler 800 also includes a dielectric load 830 that is physically connected between the first coupling section 814 and the second coupling section 818. The reason for placing the dielectric load 830 between the first and second coupling sections 814 and 818 is to disrupt the homogeneous condition of the first and second transmission lines 808 and 810. It is appreciated by those skilled in the art that in a slab line structure, the dominate propagation mode is a pure TEM mode that does not have unequal propagation velocities between an even and odd mode signals. As such, for the directional coupler 800 to operate properly as a forward directional coupler, the pure TEM mode needs to be suppressed so that a quasi-TEM mode exists that propagates even and odd mode signals with different propagation velocities. In this example, the dielectric load 830 allows the directional coupler 800 to operate as a forward directional coupler while at the same time preserving the low loss characteristics of a slab line structure. In this example, first and second transmission lines 808 and 810 may be stripline transmission lines. The dielectric load 830 may be a dielectric material such as, for example, a transparent quartz such as fused silica (also known as fused quartz), Sapphire, $Al_2O_3$ and any low loss dielectric material.

Figure 9:
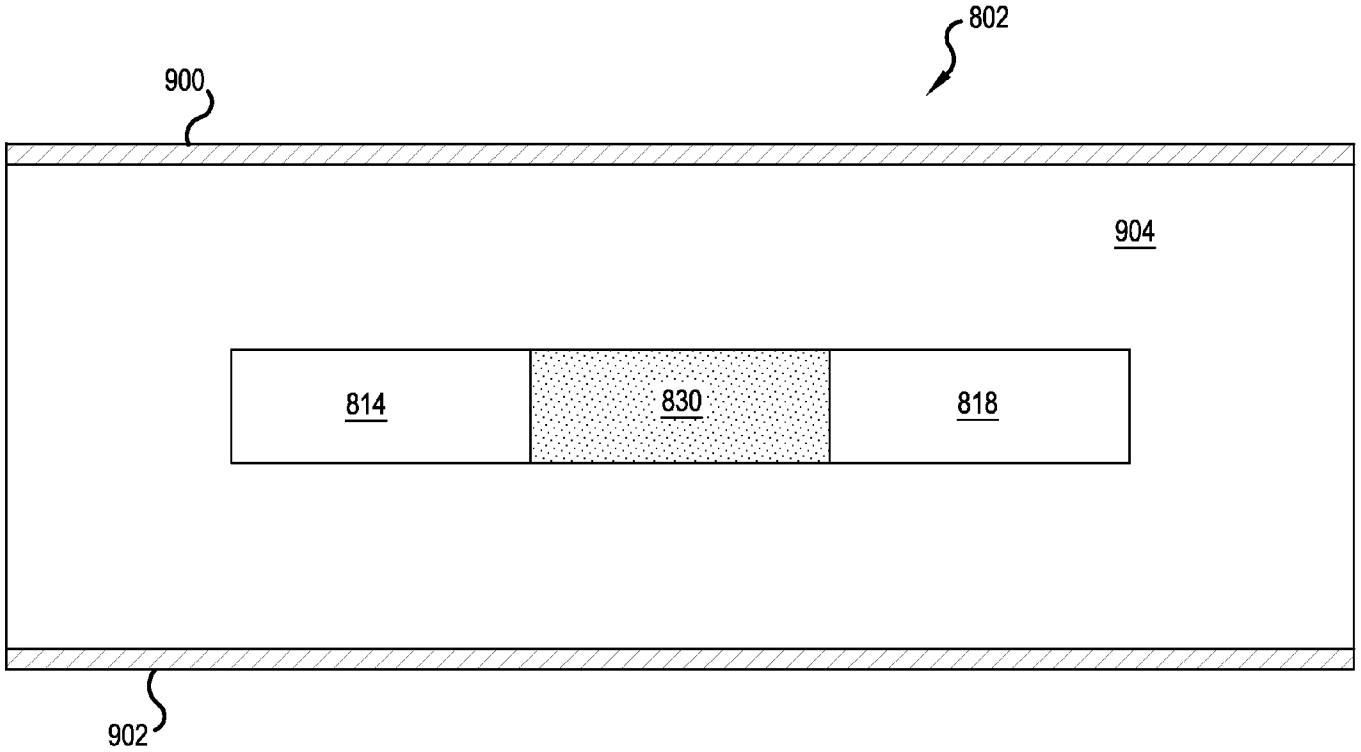
FIG. 9 is a front view of the example of the implementation of the directional coupler shown in FIG. 8.

In FIG. 9, a front view of the example of the implementation of the directional coupler 700 shown in FIG. 7 is shown. The front view of FIG. 9 is along a cut plan AA 832 shown in FIG. 8. In FIG. 9, the first and second coupling sections 814 and 818 and dielectric load 830 are shown. In this example, the slab line structure 802 includes a top conductive plate 900, lower conductive plate 902, and dielectric substrate 904, which may be, for example, air.

In an example of operation, the directional couplers 300, 700, 800 performs a process that includes propagating an input signal, at the input port, along the first coupling section in the direction of the through port and coupling the propagated input signal to the coupling port. In this example, coupling includes coupling from the first coupling section to the second coupling section across a uniform gap spacing and coupling in the direction of the propagated signal. The second coupling section has a second coupling length that is multiple wavelengths of an operating wavelength of the directional coupler. Additionally, in this example, propagating an input signal includes propagating an even mode signal having a first propagation velocity and propagating an odd mode signal having a second propagation velocity, where the first propagation velocity is different than the second propagation velocity.

Although the previous description only illustrates particular examples of various implementations, the invention is not limited to the foregoing illustrative examples. A person skilled in the art is aware that the invention as defined by the appended claims can be applied in various further implementations and modifications. In particular, a combination of the various features of the described implementations is possible, as far as these features are not in contradiction with each other. Accordingly, the foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. A directional coupler for forward coupling energy from an input port to a coupled port, the directional coupler having a coupling factor, an operating frequency, and an operating wavelength corresponding to the operating frequency, the directional coupler comprising:
- a first transmission line having the input port, a through port, and a first coupling section; and
- a second transmission line having an isolated port, the coupled port, and a second coupling section,
- wherein the first coupling section is located at a first position and the second coupling section is located at a second position, which is located proximate to the first position,
- wherein a spacing between the first position and second position define a gap spacing between the first coupling section and the second coupling section,
- wherein the isolated port is located closer to the input port than the coupled port is located to the input port,
- wherein the gap spacing is configured to minimize a transfer of energy from the input port to the isolated port,
- wherein the first coupling section has a first length and the second coupling section has a second length,
- wherein the second length is longer than a wavelength of the operating wavelength, and
- wherein the second length is predetermined to produce a transfer of energy from the input port to the coupled port that corresponds to the coupling factor.

2. The directional coupler of claim 1, wherein the first length and second length are approximately equal.

3. The directional coupler of claim 1, wherein the transfer of energy from the input port to the coupled port is a flat coupling of energy from the input port to the coupled port.

4. The directional coupler of claim 1, wherein the first transmission line is configured to propagate even mode signals, having a first propagation velocity, and odd mode signals, having a second propagation velocity, in a direction from the input port to the through port.

5. The directional coupler of claim 4, wherein the second length is configured to propagate some of the even mode signals and some of the odd mode signals from the input port to the coupled port, wherein the first propagation velocity is different than the second propagation velocity.

6. The directional coupler of claim 5, wherein the gap spacing is uniform.

7. The directional coupler of claim 6, wherein the gap spacing is equal to approximately a quarter wavelength of the operating wavelength.

8. The directional coupler of claim 6, wherein the length of the second coupling section is approximately two-and a half times the operating wavelength.

9. The directional coupler of claim 1, wherein the first transmission line is a microstrip transmission line and the second transmission line is a microstrip transmission line.

10. The directional coupler of claim 1, wherein the first transmission line is a suspended thin film microstrip transmission line and the second transmission line is a suspended thin film microstrip transmission line, and wherein the gap spacing is uniform.

11. A slab line directional coupler for forward coupling energy from an input port to a coupling port, the directional coupler having a coupling factor and an operating frequency and an operating wavelength corresponding to the operating frequency, the slab line directional coupler comprising:

a first transmission line having an input port, through port, and a first coupling section;

a second transmission line having an isolated port, the coupled port, and a second coupling section, wherein the first coupling section is located at a first position and the second coupling section is located at a second position, which is located proximate to the first position, wherein a spacing between the first position and second position define a gap spacing between the first coupling section and the second coupling section; and a dielectric load connected between the first transmission line and the second transmission line, wherein the dielectric load is configured to force the first transmission line to propagate even mode signals, having a first propagation velocity, and odd mode signals, having a second propagation velocity, in a direction from the input port to the through port, wherein the gap spacing is configured to minimize a transfer of energy from the input port to the isolated port, wherein the first coupling section has a first length and the second coupling section has a second length, wherein the second length is longer than a wavelength of the operating wavelength, and wherein the second length is predetermined to produce a transfer of energy from the input port to the coupled port that corresponds to the coupling factor.

12. The slab line directional coupler of claim 11, wherein the first length and second length are approximately equal.

13. The slab line directional coupler of claim 11, wherein the transfer of energy from the input port to the coupled port is a flat coupling of energy from the input port to the coupled port.

14. The slab line directional coupler of claim 11, wherein the second length is configured to propagate some of the even mode signals and some of the odd mode signals from the input port to the coupled port, wherein the first propagation velocity is different than the second propagation velocity.

15. The slab line directional coupler of claim 14, wherein the gap spacing is uniform for the second length between the first coupling section and the second coupling section.

16. The slab line directional coupler of claim 15, wherein the gap spacing is equal to approximately a quarter wavelength of the operating wavelength.

17. The slab line direction coupler of claim 15, wherein the length of the second coupling section is approximately two and a half times the operating wavelength.

18. The slab line directional coupler of claim 11, wherein the first transmission line is a stripline transmission line and the second transmission line is a stripline transmission line.

19. A directional coupler configured to forward coupling energy from an input port to a coupled port, the directional coupler having a coupling factor, an operating frequency, and an operating wavelength corresponding to the operating frequency, the directional coupler comprising:

a first transmission line comprising the input port, a through port, and a first coupling section, the first coupling section having a first length; and a second transmission line comprising an isolated port, the coupled port, and a second coupling section, the second coupling section having a second length, the second length being longer than a wavelength of the operating wavelength, wherein the second length is predetermined to produce a transfer of energy from the input port to the coupled port that corresponds to the coupling factor.

20. The directional coupler of claim 19, wherein the transfer of energy from the input port to the coupled port is a flat coupling of energy from the input port to the coupled port.

21. The directional coupler of claim 19, wherein the first transmission line is a microstrip transmission line and the second transmission line is a microstrip transmission line.

22. The directional coupler of claim 19, further comprising:

a spacing between a first position and a second position, the spacing defining a gap spacing between the first coupling section and the second coupling section.

23. The directional coupler of claim 22, wherein the gap spacing is configured to minimize a transfer of energy from the input port to the isolated port.

24. The directional coupler of claim 19, wherein the first transmission line is configured to propagate even mode signals, having a first propagation velocity, and odd mode signals, having a second propagation velocity, in a direction from the input port to the through port.

25. The directional coupler of claim 24, wherein the second length is configured to propagate some of the even mode signals and some of the odd mode signals from the input port to the coupled port, wherein the first propagation velocity is different than the second propagation velocity.

26. The directional coupler of claim 25, wherein the gap spacing is uniform.

27. The directional coupler of claim 26, wherein the length of the second coupling section is approximately 2.5 times the operating wavelength.

28. The directional coupler of claim 26, wherein the gap spacing is equal to approximately a quarter wavelength of the operating wavelength.

* * * * *